United States Patent [19]

Bonvetti, III

[11] 4,127,273

[45] Nov. 28, 1978

[54] SIMULATED GOLF GAME

[76] Inventor: Domenico R. Bonvetti, III, 130 Jay Dr. Chelsea Estates, New Castle, Del. 19720

[21] Appl. No.: 826,318

[22] Filed: Aug. 22, 1977

[51] Int. Cl.[2] ..... A63F 3/00

[52] U.S. Cl. ..... 273/245; 273/148 A

[58] Field of Search ..... 273/245, 148 A

[56] References Cited

U.S. PATENT DOCUMENTS

| | | | |
|---|---|---|---|
| 2,478,949 | 8/1949 | Snyder | 273/245 |
| 3,944,229 | 3/1976 | Feeney | 273/245 |

FOREIGN PATENT DOCUMENTS

| | | | |
|---|---|---|---|
| 1,362,651 | 8/1974 | United Kingdom | 273/245 |

*Primary Examiner*—Anton O. Oechsle
*Attorney, Agent, or Firm*—C. Walter Mortenson

[57] ABSTRACT

This invention affords the public a game that simulates a round of golf with each player being exposed to the same degree as to the chance elements. Every player has individual marking elements for use in his playing the course and in his pursuing the chance game squares in which pursuit he gains or loses play money through the drawing of chance cards that are also related to the round of golf. The game board provides a simulated golf course and said game squares. Associated with these are a plurality of shot cards, a plurality of chance cards, a plurality of play money and control elements for determining various moves on the game squares and various golf shots.

10 Claims, 9 Drawing Figures

SIMULATED GOLF GAME

BACKGROUND OF THE INVENTION

There are numerous prior art references relating to game boards that simulate a game of golf. In such board games it is difficult to devise a game that closely parallels conditions during actual play on the course. For example, once a player has gotten his ball on the green, he may take one or several putts, depending not only on his skill but on other factors such as the wettness of the grass, the presence of slight, virtually unnoticeable slopes or depressions, among others. These are chance elements. Hithertofore, such chance elements that relate to the actual game have not been built into the board game to correlate the chance elements in the board game to the chance elements in the actual game.

Thus, it is an object of this invention to provide a board game that effects the correlation of chance at the board game to the chance aspects on the course. A further purpose is the provision of a simulated golf game in which each player enjoys relatively the same opportunities to be low scorer or to be the "big money" winner. A still further aim is providing a simulated golf game which contains control elements for determining certain moves or certain golf strokes. These and further purposes will appear hereinafter.

This invention will be further understood by reference to the description below and to the drawings, all of which is given for illustrative purposes only and is not limitative, the drawings of which are described below.

DETAILED DESCRIPTION OF THE INVENTION

Figure 1:
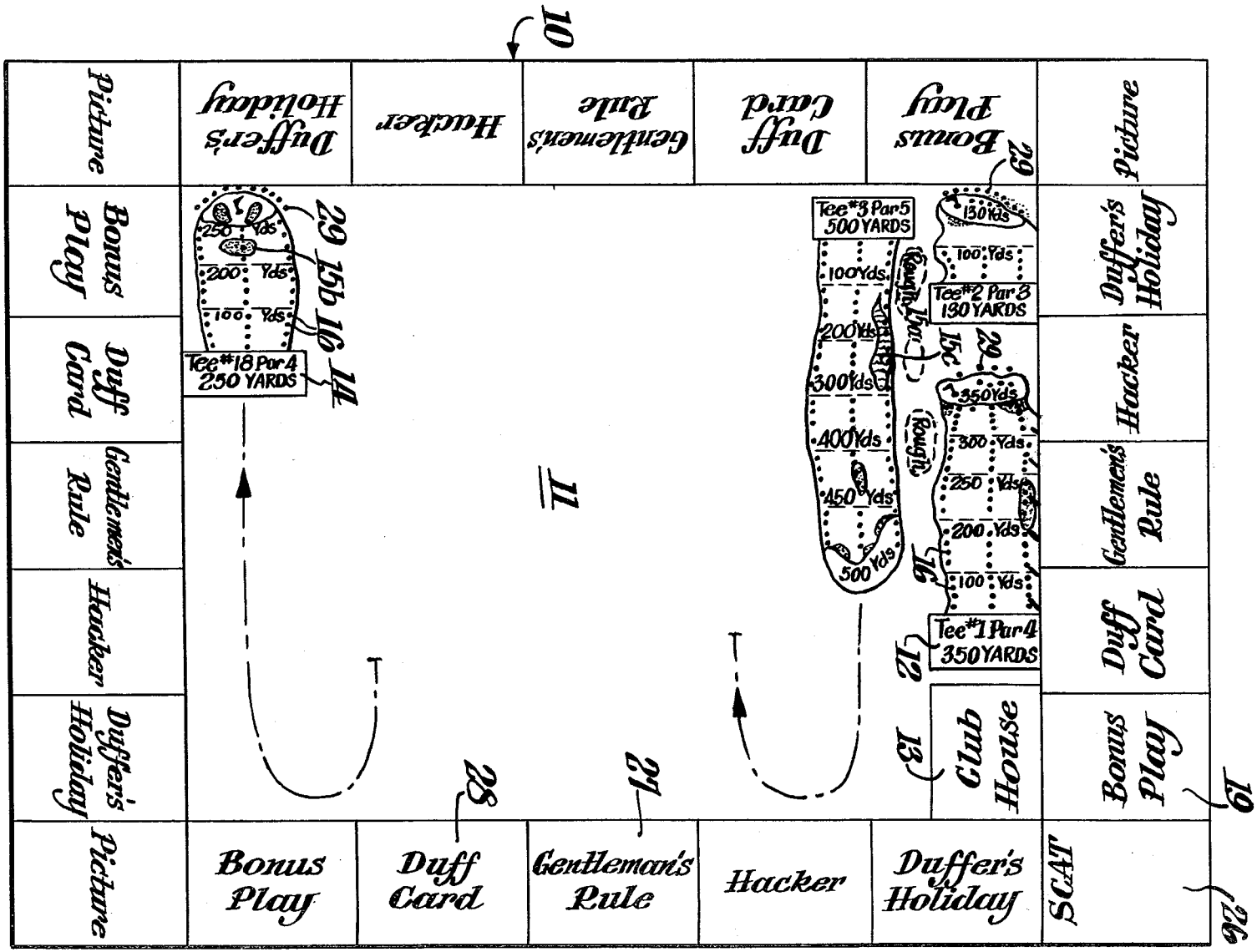
FIG. 1 is a plan view of a golf course showing a few typical holes.

As can be seen from FIG. 1 the board 10 has in its center part 11 a simulated golf course, shown only partly for convenience. While the board provides for 18 holes, the game can be played for any number, such as for a 9 hole round. It will be appreciated that holes not shown will be typical golf holes.

Figure 8:
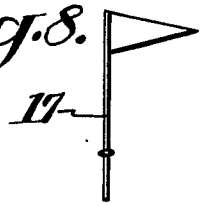
FIG. 8 and FIG. 9 are side views of markers used in this invention.
Figure 9:
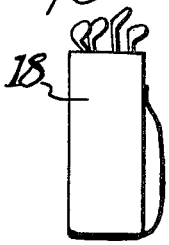

Tee #1 is shown at 12 near club house 13 followed by Tee #2, Tee #3, and so forth, ending with that #18 at 14. As can be seen, each of the depicted holes of golf have indicia thereon showing the yardage involved, the par for the given hole, locations of rough (15*a*, for example), sand traps such as 15*b*, or water as at 15*c*. The board 10 is made of a wood or plastic solid substance and each of the holes has several lines of peg holes as at 16 which have a diameter adapted for the snug insertion of a marker, such as the flag element 17 shown in FIG. 8. Since most games of golf are usually played with no more than four persons participating, the game of this invention usually comprises only four such flags 17, each of a different color. However, more such flags, as well as other pieces of equipment, are generally provided should it be desired to have a greater number of players than four to play the game at a particular time.

In addition to the play on course 11, each player must make moves relative to the game squares 19, on the perimeter of the board. Each player, therefore, is also given another marker, such as the simulated bag of clubs 18, which bears the same color as the flag 17 that he is given. This piece of equipment can be made of a plastic material and be of a thin, flat design, or it can be made so that it can stand upright. This device 18 is used to mark a given player's position as he progresses from square to square 19 shown in FIG. 1.

Figure 3:
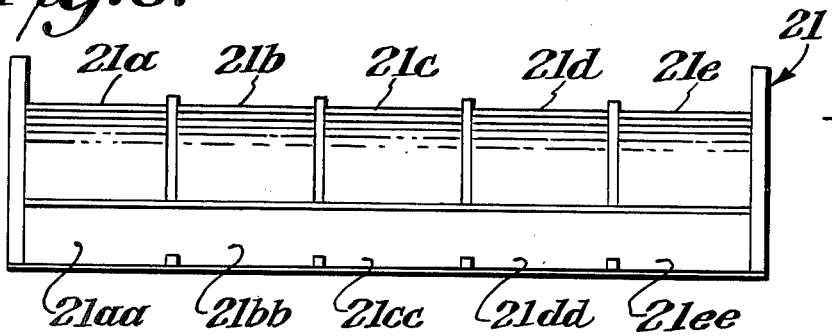
FIG. 3 is an end view of a card holder.
Figure 4:
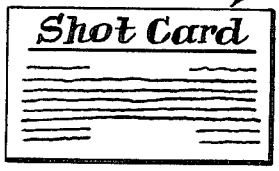
FIG. 4 is a plan view of a card.

As can be seen there, these squares bear different markings each of which bears a legend that relates to a shot or duff card such as that 20 shown in FIG. 4. These cards are contained in a tray 21 such as shown in FIG. 3.

There are a total of 50 duff cards. Of these, 25 merely indicate that the player has topped his ball or swung and missed or the like and must add one stroke to his score. There are 10 cards marked "Sand Duff" and he who draws that card must move his ball back to a position nearest the first sand trap on the subject hole. If there is no trap behind of his position, his flag remains where it is, and he adds one stroke to his score. There are 10 "Duffer" cards. The player who receives one adds a stroke to his score unless he has already drawn such a card for the particular hole. He who draws a "Lucky Duff" card (one of 5) gives it to the player who has the lowest total of strokes in the game at that point who must add a stroke to his score for the hole then in play. All 50 of the duff cards are initially contained in chamber 21*a* of tray 20. As cards are drawn, they may be placed in chamber 21*aa* or replaced in the pack which is then reshuffled.

Figure 6:
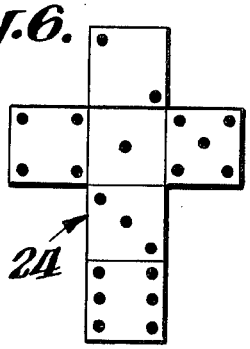
FIG. 6 and FIG. 7 are exploded views of the dice used in this invention.
Figure 5:
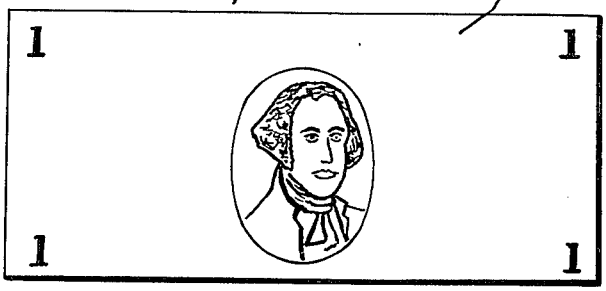
FIG. 5 is a plan view of a piece of play money.

The game has as an object to get the lowest score and to accumulate the most money. A given amount of play money 22, shown in FIG. 5, is supplied to each of the players. One of the players is declared to be the banker. He hands out to each of the players a total sum of $2,000 in play money, each player receiving 18 $100 bills, 2 $50 bills and 4 $25 bills. In addition to receiving the play money, flag 17 and player piece 18, each player receives for his use a putting spinner 23 shown in FIG. 2. With everyone participating having these elements in hand and ready to play, a toss of a die such as that shown in FIG. 6 as element 24 determines which player shall go first, the one receiving the highest roll being the player to start the game.

Contained in tray 21 are cards in addition to the duff cards 21*a*. For example, in chamber 21*b* there are 50 "Drive" cards; in chamber 21*c* there are 36 "Fairway" shot cards; in 21*d* are 36 "Long Iron" shot cards; and in 21*e* are 16 "Short Iron" shot cards.

The 50 "Drive" cards are made up of a number of cards indicating the drive effected, as follows with reference to a right-handed player:

5 for a 300 yard drive straight down the middle;
10 for a 200 yard drive straight down the middle;
5 for a 200 yard drive, sliced (to the right);
5 for a 200 yard drive, hooked (to the left);
5 for a 200 yard drive, sliced, out of bounds for which the player must take a penalty stroke unless the particular hole has no out of bounds, in which event he merely places his ball at the appropriate yardage peg hole;
5 for a 200 yard drive, hooked, out of bounds; Again, there being no penalty unless there is an out of bounds on that particular hole at that place, in which event the player places the flag 17 at the appropriate yardage;

5 for a 100 yard, duffed drive down the middle;

5 for a 100 yard, duffed drive, sliced;

5 for a 100 yard, duffed drive, hooked.

Similarly, the 36 cards of "Fairway" shot cards are made up of a number of cards indicating the yardage and the shot effected, as follows:

4 for a 200 yard fairway wood straight down the middle;

4 for a 200 yard fairway sliced wood shot;

4 for a 200 yard fairway hooked wood shot;

8 for a 200 yard fairway wood sliced, out of bounds;

8 for a 200 yard fairway wood shot hooked, out of bounds;

4 for a 100 yard fairway wood shot duffed but straight down the middle;

2 for a 100 yard fairway wood shot duffed, sliced;

2 for a 100 yard fairway wood shot duffed, hooked.

Here, again, if a given hole has no out of bounds, the player does not take a penalty stroke, but places his indicator 17 at the appropriate yardage.

This is also true for out of bounds shots indicated by any of the 36 "Long Iron" shot cards. Of these:

4 indicate a 3-iron, 170 yard straight shot;

2 indicate a 3-iron, 170 yard sliced shot;

2 indicate a 3-iron, 170 yard hooked shot;

4 indicate a 3-iron, 170 yard sliced, out of bounds shot;

4 indicate a 3-iron, 170 yard hooked, out of bounds shot;

4 indicate a 5-iron, 150 yard straight shot;

4 indicate a 5-iron, 150 yard sliced shot;

4 indicate a 5-iron, 150 yard hooked shot;

4 indicate a 5-iron, 100 yard duffed shot, sliced; and 4 indicate a 5-iron, 100 yard duffed, hooked shot.

Of the 16 "Short Iron" shot cards, 2 indicate a 6-iron, 125 yard straight shot;

2 indicate a 6-iron, 125 yard sliced shot;

2 indicate a 6-iron, 125 yard hooked shot;

2 indicate a 6-iron, 125 yard duffed shot, and requires the player to try again from the same distance, adding a stroke;

2 indicate an 8-iron, 100 yard straight shot;

2 indicate an 8-iron, 100 yard sliced shot;

2 indicate an 8-iron, 100 yard hooked shot; and 2 indicate an 8-iron, 100 yard duffed shot requiring the player to try again and to add a stroke to his score.

As can be seen from the above, the better the shot, the fewer is the number of cards that effect such a shot. Thus, the element of chance is correlated to actual play for no player consistently hits every shot straight down the middle.

With the shot cards shuffled and placed in their respective container in tray 21, the player draws a card from the container containing cards (21*b*) that relate only to driving the ball from the tee. That card will tell the player that he has driven the ball 100 yards, 200 yards, etc., as the case may be, and with that indication that player places his flag 17 in the appropriate hole 16 on the given golf hole that is being played. After doing so, the player then rolls die number 24. He then places his player piece 18 on the given outside square 19 that corresponds to the number that he has rolled. In other words, he moves his player piece 18 from scat position 26 three squares forward or to "Gentleman's Rule" square 27 if he rolled a 3 going in a clockwise direction or to "Duff Card" square 28 if he rolled a 4, and so on. If he draws a "Gentleman's Rule" spot on the outside board, he receives $50 in play money from the bank for being a gentleman and a good sport. If he draws a "Duff Card", he then has to continue his play as instructed on that card. A "Bonus Play" landing nets the player $25 in play money from each of the other players which is in addition to any money that he might win in a given hole that is being played. A landing in the "Hacker" square adds one stroke to his score for the particular hole that is being played. A landing on a "Duffer's Holiday" square will indicate to the player that he has made a particular shot of some kind which he may or may not accept depending on his position on the board. If he refuses, he must pick another card and then abide by it. However, if he is already on the green and lands in the "Duffer's Holiday", he simply ignores that landing and leaves his player piece on "Duffer's Holiday" and awaits his next turn. It will be appreciated that as the play on a given hole progresses, each player will be moving his player piece 18 on the outside board according to the roll of the die made after the completion of each shot. When he passes the square "Scat", 26, he rolls the die again and he receives from the bank $25 of play money for each spot on the die that comes up. In other words, if he rolls a six he receives $150 play money, for example.

After each of the players has completed his drive, the next shot is started with the players playing in the same sequence as that done on their drives. A given player must decide whether to use a long iron shot, a fairway wood shot or a short iron and the like. He draws the appropriate card and moves his flag to the appropriate spot. If he overdrives the green by less than 25 yards he places his flag 17 on the green. However if he hits the ball more than 25 yards past the green he must then place his flag in one of the holes 29 just behind the green. His next shot would be a pitch shot or a sand trap shot depending upon the design of the particular hole. After he makes his second shot he again rolls die 24 and moves his player piece 18 the appropriate number of squares forward and follows the instructions given on the card that he draws corresponding to the square in which his player piece 18 lands. In effecting a fairway wood shot or a long iron shot or a short iron shot each player picks a card from the appropriate pile designated for those shots.

Figure 7:
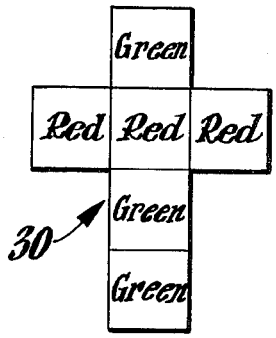

If he has a chip shot or a sandtrap shot to make, a different procedure is involved. In this procedure the player rolls two dice, one of which is shown as element 30 in FIG. 7. Each of these has three red sides and three green sides. If the dice come up with each die showing a green topside, he then places his ball or marker 17 on the green. If the dice come up with two red topsides, the player has muffed the shot and must shoot again; adding a stroke. Should the dice come up with one red and one green topside, the player has landed on the green but has rolled off on the other side and must shoot again. Every shot each player takes, is, of course, indicated on a score pad. One of the players usually is the score keeper. The shot cards can be placed in corresponding chambers 21*bb*, 21*cc*, 21*dd* and 21*ee* as the play progresses or added back into respective piles. In any event the cards are repacked and reshuffled as the need arises and as agreed upon at the outset of the game.

Figure 2:
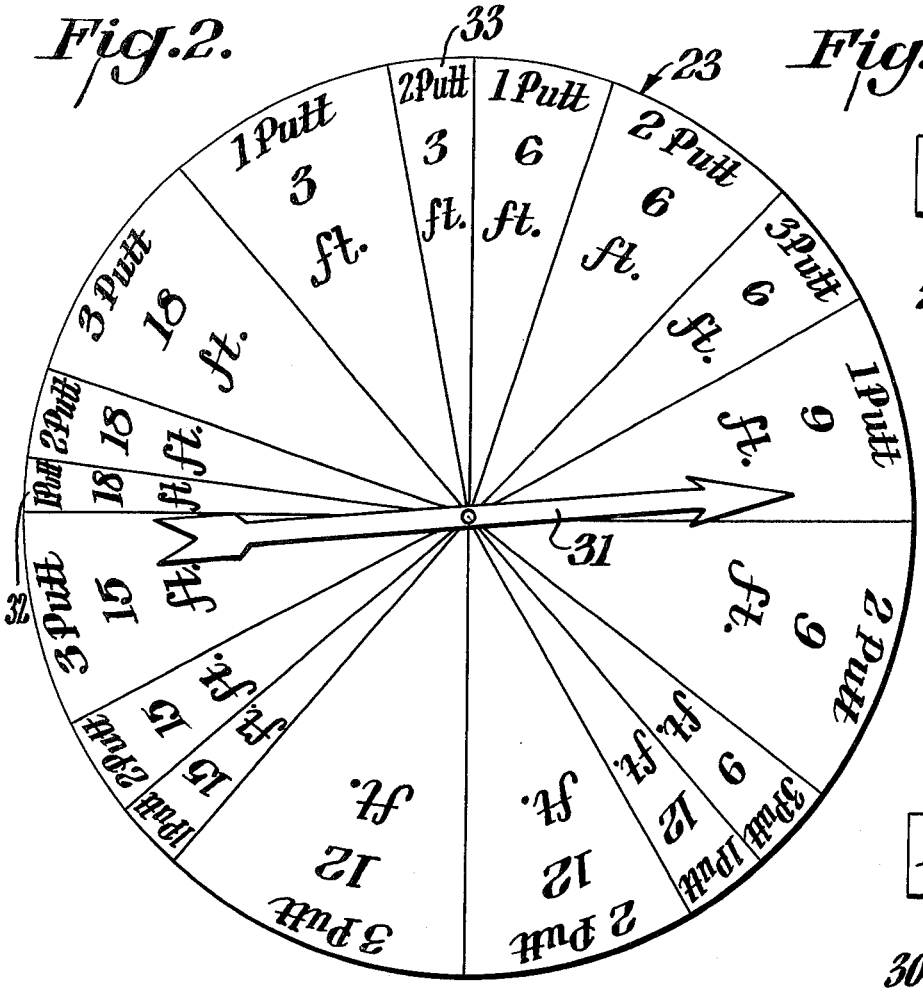
FIG. 2 is a plan view of a spinner to be used in determining the number of putts taken by a given player.

Eventually each of the players will be on the green. As each player gets on the green, he rolls die 24 and multiplies the number on the topside that comes up by three to determine how far his ball is from the pin. For example, if the dice comes up with a three, the player has a 9 foot putt. If he comes up with a six he is 18 feet away from the pin. Having determined the distance from the hole, the given player then spins the rotatable arrow 31 on spinner 23. As indicated in FIG. 2, the spinner is divided into a variety of sections. The more uncommon or the more difficult the putt the smaller the segments are, in other words, the less chance the arrow will have of landing in the segment. For example, segment 32 is very small in area since it relates to sinking an 18 foot putt. Similarly segment 33 calling for taking two putts to sink a three foot putt is relatively small. In any event the player must spin until a spin lands in one of the three segments provided for the specific initial distance of the putt. When the spinner comes to rest in one of the segments, the player then adds to the number of strokes that he has taken to get on the green the number of putts which his segment indicates. If spinner 31 lands precisely on a dividing line of FIG. 2 of adjacent segments, the player must spin again. To move the game along, it can, of course, be a rule that if after a given number of spins, say 5, the player has not gotten the spinner to rest as required, he must take the maximum of putts indicated, usually 3. Again, after completing his putting he rolls die 24 and moves his player piece 18, but since he has finished the hole and is between holes any play on the outside board calling for additional strokes is disregarded. For example, if the player who has just holed out lands on the "Hacker" square, he simply disregards that landing and leaves his player piece 18 on that square but adds nothing more to his score for the particular hole that he has just finished.

As can be seen in FIG. 2, only two sections for a 3 foot putt are provided with the 2 putt section being less in area by far than the 1 putt section. As to an 18 foot putt, there are three sections, with the section for 1 putt at this distance being very small, the 2 putt about twice that of the 1 putt section and the 3 putt area being by far the larger. By this arrangement the element of chance in the board game is correlated to the actual play and what usually happens there. There can, of course, be provided shot cards for holing out without putting as for example a hole-in-one shot or a shot from the fairway, trap or the like which holes out. Such shots clearly involve great chance elements. To correlate the chance elements would require the use of a large number of cards. Accordingly, such shots generally are not provided for in the game of this invention though they may be, if desired.

It is also to be appreciated that a number of the cards will indicate the landing of a ball out of bounds and the like. Thus, there are general rules of golf that will apply to this game. For example, if a player's ball goes out of bounds, he must take a penalty stroke. If the ball lands in a lake or in a pond, he must place his flag at the point where it was furthest from the pin and add a stroke to his score. If a player's total score is higher than nine, his score automatically becomes a nine. Similarly, there are some rules of golf that do not apply in order to make the game move faster. Thus, if on a tee shot the drive card indicates that he has driven the ball out of bounds at a certain yardage, the player does not draw another drive card but simply places his flag 17 at the yardage indicated where he went out of bounds, but he must take a penalty stroke. In other words, if a player's drive card indicates that he drives 200 yards but the ball went out of bounds he would place his flag in a 200 yard peg hole and would have taken two strokes to get there.

Since one of the objectives of this game is to accumulate as much play money as possible, the score keeper will announce at the end of each hole who received the lowest score for each hole. The player making the lowest score on that given hole receives from the other players $100 of the play money. If there is a tie score on a given hole, those that have tied will roll die 24 to determine who receives the said $100 from the remaining players, the one tossing the highest number being the recipient. Those that tied but rolled lower numbers do not have to pay the winner said sum. At the end of nine holes of play the man with the lowest score for nine holes receives as a bonus the sum of $300 in play money from the bank. This procedure is repeated after the second nine holes of play. Then each of the players adds his score for the first nine to that of the second nine, but the player having the lowest total does not receive any additional monies from the bank. Since a player may be forced to pay out monies as that player piece 18 goes around the board, it could be that he runs out of money before the 18 holes are completed. In that event he is given an additional $200 from the bank so that he may remain in the game at least temporarily.

By this invention a game is provided in which golf enthusiasts may enjoy a game of simulated golf in which chance elements they encounter in actual play are built into the board game. Players will recall actual events and anecdotes will follow. Additionally, the "Scat" aspect of the game of this invention adds interest.

While the invention has been disclosed herein in connection with certain embodiments and certain structural and procedural details, it is clear that changes, modifications or equivalents can be used by those skilled in the art; accordingly, such changes within the principles of the invention are intended to be included within the scope of the claims below.

I claim:

1. Apparatus for a golf game comprising, in combination, a game board containing on its top surface a first set of indicia indicating a plurality of golf holes comprising fairways, greens and hazzards;

as to each hole, a series of perforations each capable of holding therein a first marker, said perforations being related to a second set of indicia indicating the distance a given perforation is from the given green;

said first marker;

said second set of indicia;

a plurality of cards each of which indicates a particular golf shot and its effect;

a plurality of game squares on said board some of which bear names related to a plurality of chance cards each of which indicates a move to a named game square and the effect of said move, there being at least one game square bearing the term "SCAT" or the like which relates only to the payment of play money;

said plurality of chance cards;

a second marker distinctively identifiable with said first marker;

a plurality of play money;

a first control element for determining the distance a given ball on the green is from the cup;

a second control element for determining the number of putts needed to hole-out said given distant ball; and a third control device for determining the effect of an attempt to shoot out of a sandtrap.

2. Apparatus in accordance with claim 1 in which said plurality of cards comprises cards indicating the drive effected, cards indicating the fairway shots effected, and cards indicating a bungled shot.

3. Apparatus in accordance with claim 1 in which said first control element is a die.

4. Apparatus in accordance with claim 1 in which said second control element is a spinner.

5. Apparatus in accordance with claim 4 in which said spinner bears on its face a plurality of segments each of which bears indicia indicating the length of a putt to be made and the number of putts needed.

6. Apparatus in accordance with claim 1 in which said third control element comprises dice each of which is similarly colored with three sides of one color and three sides of a second color.

7. Apparatus in accordance with claim 1 which includes a card holder containing a plurality of card receptacles.

8. Apparatus in accordance with claim 5 in which said segments are of decreasing area in proportion to the distance the ball on the green is from the cup.

9. Apparatus in accordance with claim 1 in which there is a plurality of said series of perforations, each perforation in said series being in a line and there being a series for each player, usually four for a four-some.

10. Apparatus in accordance with claim 1 in which there is a plurality of said first and said second markers comprising a related set one for each player, usually four for a four-some.

* * * * *